252-95 AU 166 EX
12/23/80 XR 4,240,920

United States Patent [19]
de Luque
[11] 4,240,920
[45] Dec. 23, 1980

[54] DETERGENT BLEACH COMPOSITION AND PROCESS

[75] Inventor: Manuel J. de Luque, Worms, Fed. Rep. of Germany

[73] Assignee: The Procter & Gamble Company, Cincinnati, Ohio

[21] Appl. No.: 15,677

[22] Filed: Feb. 27, 1979

[30] Foreign Application Priority Data

Feb. 28, 1978 [CA] Canada ..... 297842

[51] Int. Cl.[3] ..... C11D 7/38; C11D 7/18; C11D 7/56

[52] U.S. Cl. ..... 252/99; 232/95; 8/101; 8/103; 8/661

[58] Field of Search ..... 252/95, 99; 8/101, 103, 8/1 XA

[56] References Cited

U.S. PATENT DOCUMENTS 3,927,967 12/1975 Speakman ..... 252/95 X
4,033,718 7/1977 Holcombe et al. ..... 252/103 X
4,094,806 6/1978 Wiers ..... 252/99 X

FOREIGN PATENT DOCUMENTS 7803093 9/1978 Netherlands .

*Primary Examiner*—Mayer Weinblatt
*Attorney, Agent, or Firm*—William H. Gould; Thomas H. O'Flaherty; Richard C. Witte

[57] ABSTRACT

Combined washing and bleaching of fabrics is accomplished by use of a composition comprising a mixture of surfactant, peroxy bleach, and porphine bleach. The surfactant is anionic, nonionic, semi-polar, ampholytic, zwitterionic, or cationic in nature. The peroxy bleach is inorganic or organic. The porphine bleach is a porphine or a mono-, di-, tri-, or tetra-aza porphine, solubilized with anionic, nonionic and/or cationic substituent groups, and metal free or metallated with Zn(II), Cd(II), Mg(II), Ca(II), Al(III), Sc(III) or Sn(IV).

29 Claims, No Drawings

DETERGENT BLEACH COMPOSITION AND PROCESS

BACKGROUND OF THE INVENTION

This invention relates to household laundry processes for combined washing and bleaching of fabrics, and to simultaneous removal of stains and fugitive dyes.

British Pat. No. 1,372,035 (Speakman) published on Dec. 23, 1975 related to a household washing and bleaching process for cotton fabrics utilizing photoactivating compounds, principally sulfonated zinc phthalocyanine, in a built detergent composition in the presence of visible light and atmospheric oxygen. In a patent of addition, British Pat. No. 1,408,144 published Jan. 28, 1976, Speakman disclosed a surfactant/builder composition which was dissolved in water to form a solution to which was added, both separately and together, sodium perborate and sulfonated zinc phthalocyanine. Bleaching effects of the combination were said to be greater than would have been expected from the two components acting independently. It was postulated that the sulfonated zinc phthalocyanine enabled evolved oxygen from the sodium perborate, which would otherwise escape unused as molecular oxygen, to be converted into singlet oxygen which acted as the active chemical bleaching agent.

U.S. Pat. No. 4,033,718 granted to Holcombe et al on July 5, 1977 teaches the use of specific mixtures of sulfonated zinc phthalocyanine species, principally tri- and tetra-sulfonates, as preferred bleach photoactivators.

Belgian Pat. No. 840,348 invented by Wiers, granted on Oct. 4, 1976 discloses the use of zinc phthalocyanine tri- and tetra-sulfonates as bleach photoactivators in unbuilt liquid detergent compositions.

British Pat. No. 1,372,036 invented by Speakman and published on Oct. 30, 1974 describes a washing machine provided with a source of visible light which irradiates wash liquor containing phthalocyanine photoactivator and fabrics. An example comparable to that described in British Pat. No. 1,408,144 described above showed results consistent therewith.

In Canadian patent application No. 274,869 filed Mar. 28, 1977, Goodman eliminated the blue-green staining problem inherent in previous work by using much reduced concentrations of zinc phthalocyanine sulfonate in conjunction with a long pre-wash soaking time. As little as 0.003% photoactivator was needed in conjunction with 18-hour soaking, which could optionally take place under illumination or in the dark. Light was, however, believed essential during the drying step which takes place after washing.

In Philippine patent applications Nos. 20,644 and 20,643 filed Jan. 11, 1978 substantially corresponding to U.S. applications Ser. Nos. 2414 and 2275, respectively, filed Jan. 10, 1979, Sakkab disclosed the use of many porphine derivatives as alternatives to zinc phthalocyanine sulfonate; these derivatives were solubilized by anionic, nonionic or cationic moieties introduced into the porphine molecule. Not only stain removal but also removal of fugitive dyes and improvement in overall whiteness of the fabrics was obtained.

In Philippine patent application No. 20,642 also filed Jan. 11, 1978 substantially corresponding to U.S. application Ser. No. 2415 filed Jan. 10, 1979, Sakkab disclosed the use of porphine derivatives in conjunction with cationic substances; previously thereto, usage of porphine derivatives as detergent bleaches had been limited to use with anionic, nonionic, semi-polar, ampholytic or zwitterionic surfactants. As in all previous disclosures, visible light was believed essential to operability of the bleaching process. The three Sakkab citations are incorporated herein by reference.

In all references identified above, zinc phthalocyanine sulfonate and other porphine bleaches have been referred to as "photosensitizers" or "photoactivators", and the processes of use have invariably involved the presence of visible light (640–690 nm.) at one or more stages of soaking, washing or drying. It has now been unexpectedly found that porphine bleach, in combination with peroxy bleach, is effective when the entire washing and drying process takes place in darkness.

Furthermore, the effectiveness of the combination of peroxy bleach with porphine bleach is so great that levels of peroxy and/or porphine bleach hitherto believed ineffective can be advantageously used. This represents an economic advantage, and one that might be particularly appreciated by those who are concerned about ecology and waste disposal.

SUMMARY OF THE INVENTION

This invention relates to a bleach composition comprising three components: (a) a surfactant, (b) a peroxy bleach, and (c) a porphine bleach.

The surfactant can be anionic, nonionic, semi-polar, ampholytic, or cationic. The surfactant can be used at levels from about 1% to about 50%, preferably from about 4% to about 30%, by weight of the composition.

The peroxy bleach can be an inorganic peroxide or peroxyhydrate; urea peroxide; or an organic peroxy acid or anhydride or salt thereof which has the general formula

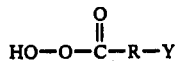

where R is an alkylene group containing from 1 to 20 carbon atoms or a phenylene group; and Y is hydrogen, halogen, alkyl, aryl or any group which provides an anionic moiety in aqueous solution.

Peroxy bleach, expressed in terms of available oxygen, is from 0.2% to 5.0%, preferably from 0.2% to 0.7%, more preferably from 0.2% to 0.5%, by weight of the composition. A conventional peroxy bleach activator, i.e. an organic peracid precursor, can be used optionally.

The porphine bleach has the general formula

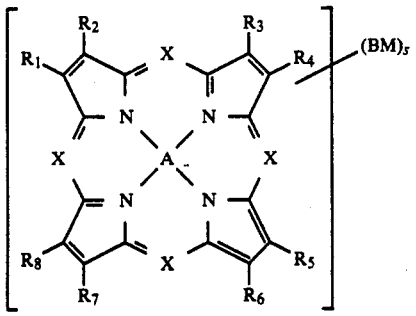

wherein each X is (=N—) or (=CY—), and the total number of (=N—) groups is 0, 1, 2, 3 or 4; wherein each Y, independently, is hydrogen or meso substituted alkyl, cycloalkyl, aralkyl, aryl, alkaryl or heteroaryl; wherein each R, independently, is hydrogen or pyrrole substituted alkyl, cycloalkyl, aralkyl, aryl, alkaryl or heteroraryl, or wherein adjacent pairs of R's are joined together with ortho-arylene groups to form pyrrole substituted alicyclic or heterocyclic rings; wherein A is 2(H) atoms bonded to diagonally opposite nitrogen atoms, or Zn(II), Cd(II), Mg(II), Ca(II), Al(III), Sc(III), or Sn(IV); wherein B is an anionic, nonionic or cationic solubilizing group substituted into Y or R; wherein M is a counterion to the solubilizing groups; and wherein s is the number of solubilizing groups.

For cationic solubilizing groups M, the counterion, is an anion such as halide and s is from 1 to about 8. For polyethoxylate nonionic solubilizing groups $-(CH_2CH_2O)_nH$, M is zero, s is from 1 to about 8, and N=(sn)= the number of (condensed ethylene oxide molecules per porphine molecule) is from about 8 to about 50. For anionic groups M, the counterion, is cationic. For anionic groups attached to atoms no more than 5 atoms displaced from the porphine core, i.e. for "proximate" anionic groups as defined herein, s is from 3 to about 8. For anionic groups attached to atoms more than 5 atoms displaced from the porphine core, i.e. for "remote" anionic groups as defined herein, s is from 2 to about 8. For sulfonate groups their number is no greater than the number of aromatic and heterocyclic substituent groups.

In the foregoing description, the term "alkyl" is defined to be not only a simple carbon chain but also a carbon chain interrupted by other chain-forming atoms, such as O, N or S.

Porphine bleach is used in amounts from 0.001 to 0.5%, more preferably from 0.003 to 0.022%, especially preferably from 0.005 to 0.017%, by weight of the composition.

Other components are optional, for instance conventional alkaline detergent builders, exotherm control agents, soil suspending agents, fluorescers, colorants, perfumes and the like. The composition of this invention may take the form of granules, liquids or bars.

DETAILED DESCRIPTION OF THE INVENTION

The essential components of the instant invention are three in number. One is a surfactant which can be anionic, nonionic, semi-polar, ampholytic, zwitterionic, or cationic in nature. Surfactants can be used at levels from about 1% to about 50% of the composition by weight, preferably at levels from about 4% to about 30% by weight.

Preferred anionic non-soap surfactants are water soluble salts of alkyl benzene sulfonate, alkyl sulfate, alkyl polyethoxy ether sulfate, paraffin sulfonate, alpha-olefin sulfonate, alpha-sulfocarboxylates and their esters, alkyl glyceryl ether sulfonate, fatty acid monoglyceride sulfates and sulfonates, alkyl phenol polyethoxy ether sulfate, 2-acyloxy-alkane-1-sulfonate, and beta-alkyloxy alkane sulfonate. Soaps are also preferred anionic surfactants.

Especially preferred alkyl benzene sulfonates have about 9 to about 15 carbon atoms in a linear or branched alkyl chain, more especially about 11 to about 13 carbon atoms. Especially preferred alkyl sulfate has about 8 to about 22 carbon atoms in the alkyl chain, more especially from about 12 to about 18 carbon atoms. Especially preferred alkyl polyethoxy ether sulfate has about 10 to about 18 carbon atoms in the alkyl chain and has an average of about 1 to about 12 $-CH_2CH_2O-$ groups per molecule, especially about 10 to about 16 carbon atoms in the alkyl chain and an average of about 1 to about 6 $-CH_2CH_2O-$ groups per molecule.

Especially preferred paraffin sulfonates are essentially linear and contain from about 8 to about 24 carbon atoms, more especially from about 14 to about 18 carbon atoms. Especially preferred alpha-olefin sulfonate has about 10 to about 24 carbon atoms, more especially about 14 to about 16 carbon atoms; alpha-olefin sulfonates can be made by reaction with sulfur trioxide followed by neutralization under conditions such that any sultones present are hydrolyzed to the corresponding hydroxy alkane sulfonates. Especially preferred alpha-sulfocarboxylates contain from about 6 to about 20 carbon atoms; included herein are not only the salts of alpha-sulfonated fatty acids but also their esters made from alcohols containing about 1 to about 14 carbon atoms.

Especially preferred alkyl glyceryl ether sulfates are ethers of alcohols having about 10 to about 18 carbon atoms, more especially those derived from coconut oil and tallow. Especially preferred alkyl phenol polyethoxy ether sulfate has about 8 to about 12 carbon atoms in the alkyl chain and an average of about 1 to about 10 $-CH_2CH_2O-$ groups per molecule. Especially preferred 2-acyloxy-alkane-1-sulfonates contain from about 2 to about 9 carbon atoms in the aryl group and about 9 to about 23 carbon atoms in the alkane moiety. Especially preferred beta-alkyloxy alkane sulfonate contains about 1 to about 3 carbon atoms in the alkyl group and about 8 to about 20 carbon atoms in the alkyl moiety.

The alkyl chains of the foregoing non-soap anionic surfactants can be derived from natural sources such as coconut oil or tallow, or can be made synthetically as for example using the Ziegler or Oxo processes. Water solubility can be achieved by using alkali metal, ammonium, or alkanolammonium cations; sodium is preferred. Magnesium and calcium are preferred cations under circumstances described by Belgian Pat. No. 843,636 invented by Jones et al, issued Dec. 30, 1976. Mixtures of anionic surfactants are contemplated by this invention; a preferred mixture contains alkyl benzene sulfonate having 11 to 13 carbon atoms in the alkyl group and alkyl polyethoxy alcohol sulfate having 10 to 16 carbon atoms in the alkyl group and an average degree of ethoxylation of 1 to 6.

Especially preferred soaps contain about 8 to about 24 carbon atoms, more especially about 12 to about 18 carbon atoms. Soaps can be made by direct saponification of natural fats and oils such as coconut oil, tallow and fish oil, or by the neutralization of free fatty acids obtained from either natural or synthetic sources. The soap cation can be alkali metal, ammonium or alkanolammonium; sodium is preferred.

Preferred *nonionic* surfactants are water soluble polyethoxylates of alcohols, alkyl phenols, polypropoxy glycols, and polypropoxy ethylene diamine.

Especially preferred polyethoxy alcohols are the condensation product of 1 to 30 mols of ethylene oxide with 1 mol of branched or straight chain, primary or secondary aliphatic alcohol having from about 8 to about 22 carbon atoms; more especially 1 to 6 mols of ethylene oxide condensed with 1 mol of straight or branched chain, primary or secondary aliphatic alcohol having from about 10 to about 16 carbon atoms; certain species of polyethoxy alcohols are commercially available from the Shell Chemical Company under the trade name 'Neodol'. Especially preferred polyethoxy alkyl phenols are the condensation product of about 1 to about 30 mols of ethylene oxide with 1 mol of alkyl phenol having a branched or straight chain alkyl group containing about 6 to about 12 carbon atoms; certain species of polyethoxy alkyl phenols are commercially available from the GAF Corporation under the trade name 'Igepal'.

Especially preferred polyethoxy polypropoxy glycols are commercially available from BASF-Wyandotte under the trade name 'Pluronic'. Especially preferred condensates of ethylene oxide with the reaction product of propylene oxide and ethylene diamine are commercially available from BASF-Wyandotte under the trade name 'Tetronic'.

Preferred *semi-polar* surfactants are water soluble amine oxides containing one alkyl moiety of from about 10 to 28 carbon atoms and 2 moieties selected from the group consisting of alkyl groups and hydroxyalkyl groups containing from 1 to about 3 carbon atoms, and especially alkyl dimethyl amine oxides wherein the alkyl group contains from about 11 to 16 carbon atoms; water soluble phosphine oxide detergents containing one alkyl moiety of about 10 to 28 carbon atoms and 2 moieties selected from the group consisting of alkyl groups and hydroxyalkyl groups containing from about 1 to 3 carbon atoms; and water soluble sulfoxide detergents containing one alkyl moiety of from about 10 to 28 carbon atoms and a moiety selected from the group consisting of alkyl and hydroxyalkyl moieties of from 1 to 3 carbon atoms.

Preferred *ampholytic* surfactants are water soluble derivatives of aliphatic secondary and tertiary amines in which the aliphatic moiety can be straight chain or branched and wherein one of the aliphatic substituents contains from about 8 to 18 carbon atoms and one contains an anionic water-solubilizing group, e.g. carboxy, sulfonate, sulfate, phosphate, or phosphonate.

Preferred *zwitterionic* surfactants are water soluble derivatives of aliphatic quaternary ammonium, phosphonium and sulfonium cationic compounds in which the aliphatic moieties can be straight chain or branched, and wherein one of the aliphatic substituents contains from about 8 to 18 carbon atoms and one contains an anionic water solubilizing group, especially alkyl-dimethyl-ammonio-propane-sulfonates and alkyl-dimethyl-ammonio-hydroxy-propane-sulfonates wherein the alkyl group in both types contains from about 14 to 18 carbon atoms.

A typical listing of the classes and species of non-cationic surfactants useful in this invention appear in U.S. Pat. No. 3,664,961 issued to Norris on May 23, 1972 and hereby incorporated herein by reference. This listing, and the foregoing recitation of specific surfactant compounds and mixtures which can be used in the instant compositions, are representative of such materials but are not intended to be limiting.

As disclosed in U.S. Patent Applications U.S. Ser. No. 811,221 invented by Cockrell and U.S. Ser. No. 811,220 invented by Murphy, both filed on June 29, 1977 and both hereby incorporated herein by reference, under appropriate circumstances *cationic* surfactants are highly effective soil removal agents. The cationic surfactants of Cockrell and Murphy applicable to the instant invention have the formula $$R_m^1R_x^2Y_LZ$$

wherein each $R^1$ is an organic group containing a straight or branched alkyl or alkenyl group optionally subsituted with up to 3 phenyl groups and optionally interrupted by up to b 4 structures selected from the group consisting of

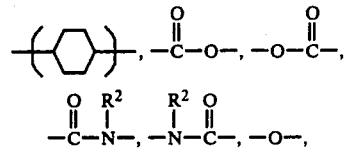

(1)

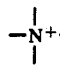

(2)

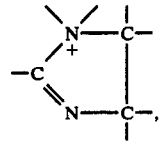

(3)

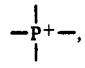

(4)

(5)

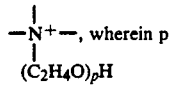

, wherein p is from 1 to 20, (6)

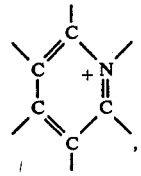

(7)

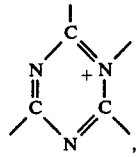

, and (8) mixtures thereof,

L is a number from 1 to 10, Z is an anion in a number to give electrical neutrality.

In cationic surfactants preferred in the practice of the instant invention, Z is a halide, methylsulfate, toluene sulfonate, hydroxide or nitrate ion, particularly preferred being chloride, bromide or iodide anions. In certain preferred cationic surfactants, L is equal to 1 and Y is as defined in paragraph (1), (2) or (5) supra; in other preferred cationic surfactants more than one cationic charge center is present and L is greater than 1, as in the substance

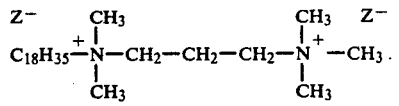

In preferred cationic materials, described above, where m is equal to 1, it is preferred that x is equal to 3, and $R^2$ is a methyl group. Preferred compositions of this monolong chain type include those in which $R^1$ is a $C_{10}$ to $C_{20}$ alkyl group. Particularly preferred components of this class include $C_{16}$ (palmityl) trimethyl ammonium halide and $C_{12}$ (coconut alkyl) trimethyl ammonium halide.

Where m is equal to 2 it is preferred that x is equal to 2, and that $R^2$ is a methyl group. In this instance it is also preferred that $R^1$ is a $C_{10}$ to $C_{20}$ alkyl group. Particularly preferred cationic materials of this class include distearyl ($C_{18}$) dimethyl ammonium halide and ditallow alkyl ($C_{18}$) dimethyl ammonium halide materials.

Where m is equal to 3, only one of the $R^1$ chains can be greater than 12 carbon atoms in length. The reason for this chain length restriction is the relative insolubility in water of these tri-long chain materials. Where tri-long chain materials are used, it is preferred that x is equal to 1 and that $R^2$ is a methyl group. In these compositions it is preferred that $R^1$ is a $C_8$ to $C_{11}$ alkyl group. Particularly preferred tri-long chain cationic materials include trioctyl ($C_8$) methyl ammonium halide and tridecyl ($C_{10}$) methyl ammonium halide.

Another particularly preferred type of cationic surfactant useful in the compositions of the present invention is of the imidazolinium variety. A particularly preferred surfactant of this type is one having the structural formula

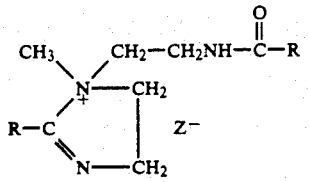

wherein R is $C_{10}$ to $C_{20}$ alkyl, particularly $C_{14}$ to $C_{20}$ alkyl.

Another type of preferred cationic surfactant for use in the compositions of the present invention are the alkoxylated alkyl quaternaries. Examples of such compounds are given below:

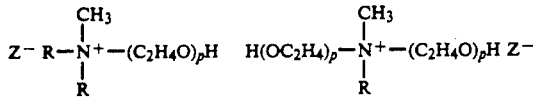

wherein p is from 1 to 20 and each R is a $C_{10}$ to $C_{20}$ alkyl group.

A particularly preferred type of cationic component, which is described in U.S. Patent Application 811,218, Letton, filed June 29, 1977, and incorporated herein by reference, has the formula:

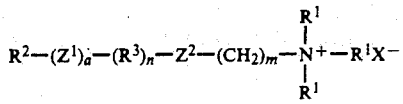

wherein $R^1$ is $C_1$ to $C_4$ alkyl or hydroxyalkyl; $R^2$ is $C_5$ to $C_{30}$ straight or branched chain alkyl or alkenyl, alkyl phenyl, or

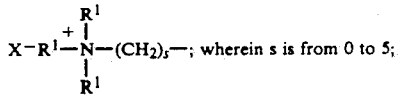

; wherein s is from 0 to 5;

$R^3$ is $C_1$ to $C_{20}$ alkyl or alkenyl; a is 0 or 1; n is 0 or 1; m is from 1 to 5; $Z^1$ and $Z^2$ are each selected from the group consisting of

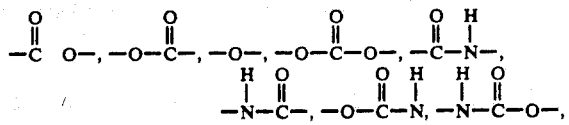

and wherein at least one of said groups is an ester, reverse ester, amide or reverse amide; and X is an anion which makes the compound at least water-dispersible, preferably selected from the group consisting of halide, methyl sulfate, and nitrate, preferably chloride, bromide or iodide.

Other preferred cationic surfactants of this type are the chlorine ester derivatives having the following formula:

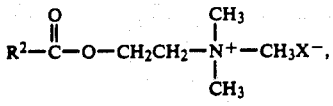

as well as those compounds wherein the ester linkage in the above formula is replaced with a reverse ester, amide or reverse amide linkage.

Particularly preferred examples of this type of cationic surfactant include stearoyl choline ester quaternary ammonium halides ($R^2=C_{17}$ alkyl), palmitoyl choline ester quaternary ammonium halides ($R^2=C_{15}$ alkyl), myristoyl choline ester quaternary ammonium halides ($R^2=C_{13}$ alkyl), lauroyl choline ester ammonium halides ($R^2=C_{11}$ alkyl), and tallowyl choline ester quaternary ammonium halides ($R^2=C_{15}$-$C_{17}$ alkyl).

Additional preferred cationic components of the choline ester variety are given by the structural formulas below, wherein p may be from 0 to 20.

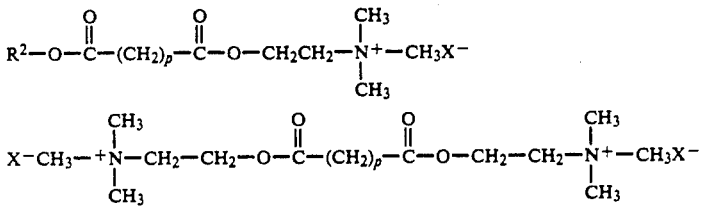

Another type of novel, particularly preferred cationic material, described in U.S. patent application Ser. No.

811,219, Letton, filed June 29, 1977, and incorporated herein by reference, has the formula:

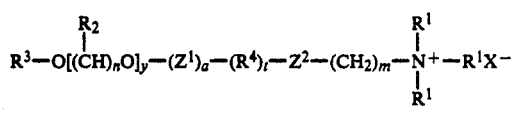

In the above formula, each $R^1$ is a $C_1$ to $C_4$ alkyl or hydroxyalkyl group, preferably a methyl group. Each $R^2$ is either hydrogen or $C_1$ to $C_3$ alkyl, preferably hydrogen. $R^3$ is a $C_4$ to $C_{30}$ straight or branched chain alkyl, alkenylene, or alkyl benzyl group, preferably a $C_8$ to $C_{18}$ alkyl group, most preferably a $C_{12}$ alkyl group. $R^4$ is a $C_1$ to $C_{10}$ alkylene or alkenylene group. n is from 2 to 4, preferably 2; y is from 1 to 20, preferably from about 1 to 10, most preferably about 7; a may be 0 or 1; t may be 0 or 1; and m is from 1 to 5, preferably 2. $Z^1$ and $Z^2$ are each selected from the group consisting of

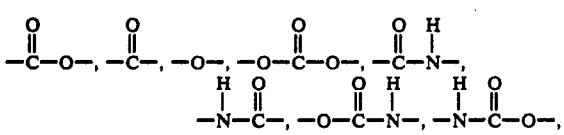

and wherein at least one of said groups is selected from the group consisting of ester, reverse ester, amide and reverse amide. X is an anion which will make the compound at least water-dispersible, and is selected from the group consisting of halides, methyl sulfate, and nitrate, particularly chloride, bromide and iodide. Mixtures of the above structures can also be used.

Preferred embodiments of this type of cationic component are the choline esters ($R^1$ is a methyl group and $Z^2$ is an ester or reverse ester group), particular examples of which are given below, in which t is 0 or 1 and y is from 1 to 20.

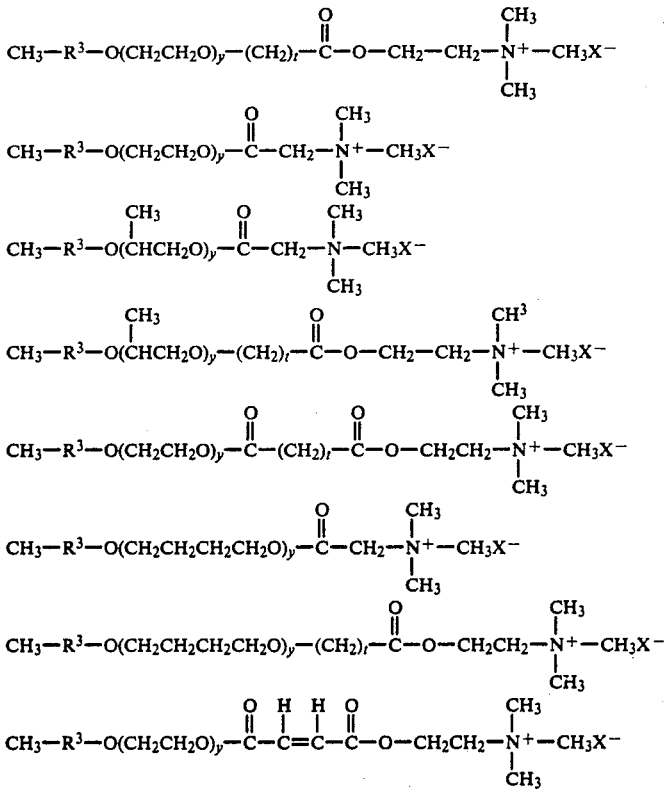

The second essential element of the instant invention is a *peroxy bleach.* The peroxy bleach can be inorganic or organic, and if the former can optionally contain a peroxy bleach activator.

By inorganic peroxy bleaches are meant inorganic peroxyhydrates; examples are alkali metal salts of perborates, percarbonates, persulfates, persilicates, perphosphates, and perpolyphosphates.

Preferred inorganic peroxy bleaches are the sodium and potassium salts of perborate monohydrate and perborate tetrahydrate. Sodium perborate tetrahydrate is especially preferred.

By organic peroxy bleach is meant urea peroxide $CO(NH_2)_2.H_2O_2$ or an organic peroxy acid or anhydride or salt thereof which has the general formula

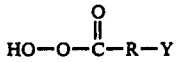

wherein R is an alkylene group containing from 1 to about 20 carbon atoms, preferably 7 to 16 carbon atoms, or a phenylene group and Y is hydrogen, halogen, alkyl, aryl or any group which provides an anionic moiety in aqueous solution. Such Y groups can include, for example,

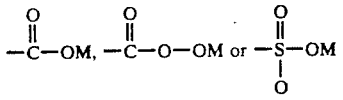

wherein M is H or a water-soluble, salt-forming cation.

The organic peroxyacids and salts thereof operable in the instant invention can contain either one or two peroxy groups and can be either aliphatic or aromatic. When the organic peroxyacid is aliphatic, the unsubstituted acid has the general formula

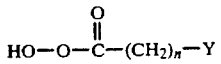

where Y, for example, can be $CH_3$, $CH_2Cl$,

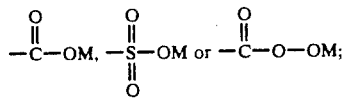

and n can be an integer from 1 to 20. Diperazelaic acid (n=7) and diperdodecanedioic acid (n=10) are the preferred compounds of this type. The alkylene linkage and/or Y (if alkyl) can contain halogen or other noninterfering substituents.

When the organic peroxyacid is aromatic, the unsubstituted acid has the general formula

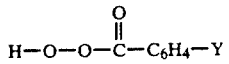

wherein Y is hydrogen, halogen, alkyl,

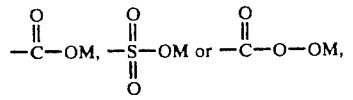

for example. The percarboxy and Y groupings can be in any relative position around the aromatic ring. The ring and/or Y group (if alkyl) can contain any noninterfering substituents such as halogen groups. Examples of suitable aromatic peroxyacids and salts thereof include monoperoxyphthalic acid, diperoxyterephthalic acid, 4-chlorodiperoxyphthalic acid, the monosodium salt of diperoxyterephthalic acid, m-chloroperoxybenzoic acid, p-nitroperoxybenzoic acid, and diperoxyisophthalic acid.

Of all the above described organic peroxyacid compounds, the most preferred for use in the instant compositions are diperdodecanedioic acid and diperazelaic acid.

By *peroxy bleach activator* is meant an organic peracid precursor containing one or more acyl groups which is susceptible to perhydrolysis. The preferred activators are those of the N-acyl or O-acyl-compound type containing an acyl radical R—CO— wherein R is a hydrocarbon group having from 1 to 8 carbon atoms. If the radicals R are aliphatic, they preferably contain 1 to 3 carbon atoms while, if they are aromatic, they preferably contain up to 8 carbon atoms. R may be unsubstituted or substituted with $C_{1-3}$ alkoxy groups, halogen atoms, nitro- or nitrilo groups. Aromatic radicals, in particular, may be chloro- and/or nitro-substituted.

Examples of activators coming within this definition follow:

(a) N-diacetylated amines of formula

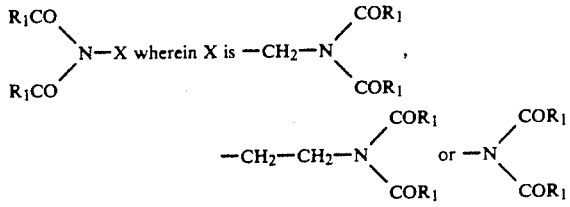

and $R_1$ is as defined above for R and may be the same or different. N,N,N', N'-tetraacetyl-methylenediamine, N,N,N',N'-tetraacetyl-ethylene-diamine, and N,N-diacetyl-p-toluidine are examples of N-diacylated amines.

(b) N-alkyl-N-sulphonyl carbonamides of formula

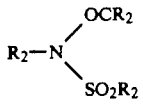

wherein $R_2$ is as defined above for R, preferably $C_{1-3}$ alkyl. Examples of suitable carbonamides are N-methyl-N-mesylacetylamide, N-methyl-N-mesyl-p-nitro benzoylamide and N-methyl-N-mesyl-p-methoxybenzoylamide.

(c) N-acylhydantoins of formula

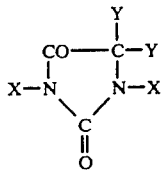

wherein at least one of X represents $R_3$—CO— while the other X represents $R_3$—CO— or an esterified carboxymethyl radical ($R_3$ as defined above for R), Y represents hydrogen or $C_{1-2}$ alkyl radicals. 1,3-diacetyl-5,5-dimethylhydantoin and 3-benzoyl-hydantoin-1-acetic acid ethyl ester are representative of the hydantoin activators.

(d) Cyclic N-acylhydrazide of formula

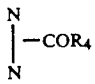

wherein the nitrogen atoms are part of a 5- or 6-numbered heterocyclic ring from the group maleic acid hydrazide, phthalic acid hydrazide, triazole or urazole and $R_4$ is as above for R. Monoacetyl-maleic acid hydrazide is one example of a satisfactory activator from this class.

(e) Triacyl-cyanurates of formula

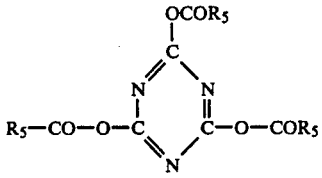

wherein $R_5$ is defined as above for R. Triacetyl- or tribenzoyl-cyanurates are examples of this activator class.

(f) Benzoic acid or phthalic acid anhydrides, substituted or unsubstituted. Examples are benzoic anhydride or m-chlorobenzoic anhydride.

(g) O,N,N-trisubstituted hydroxyl amines of formula

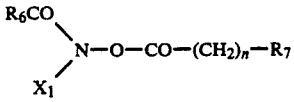

wherein $R_7$ is as defined above for R, preferably $C_{1-2}$, aryl radical or

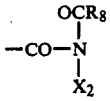

and $X_1$ and $X_2$ are $R_9CO$—, $R_9$—$SO_2$— which can be linked with $R_6$ or $R_8$ to give a succinyl- or phthalyl residue, $R_{6-9}$ being defined as above for R, and n is from 0–2. Examples of this type of activator include O-benzoyl-N,N-succinyl-hydroxylamine, O-acetyl-N,N-succinyl-hydroxylamine, O-p-nitrobenzoyl-N,N-succinyl-hydroxylamine, and O,N,N-triacetylhydroxylamine.

(h) N,N'-diacyl-sulphurylamide of formula

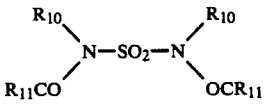

wherein $R_{10}$ represents preferably $C_{1-4}$ alkyl radicals, or aryl radicals and $R_{11}$ represents preferably $C_{1-5}$ alkyl radicals. N,N'dimethyl-N,N-diacetyl-sulphurylamide is one example of a satisfactory activator of this class.

(i) 1,3-diacyl-4,5-dialyloxy-imidazolidine of formula

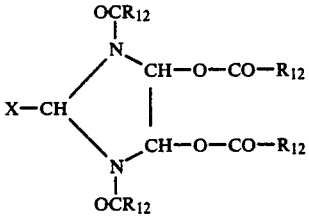

wherein $R_{12}$ is as defined above for R and X is hydrogen or R. 1,3-diformyl-4,5-diacetoxy-imidazolidine and 1,3-diacetyl-4,5-diacetoxy-imidazolidine are representative examples of this activator class.

(j) Acylated glycolurils of formula

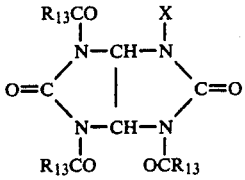

wherein $R_{13}$ is as defined above for R and X represents R or R—CO. Tetraacetylglycoluril, di-(chloracetyl)-diacetyl-glycoluril, tetrapropionylglycoluril, 1-methyl-3,4,6-triacetyl-glycoluril, and diacetyldibenzoyl-glycoluril are suitable examples of the glycolurils of this invention.

(k) Carboxylic esters as disclosed in British Pat. No. 836,988, for instance sodium p-acetoxybenzene sulphonate, sodium p-benzyloxy benzene sulphonate, acetyl salicylic acid and chloracetoxysalicylic acid.

Of all the above activators, particularly preferred are: N,N,N',N'-tetraacetyl ethylene diamine, N-acetyl imidazole, N-benzoyl imidazole, N,N'-dimethyl barbitone, N,N'-diacetyl-5,5'-dimethylhydantoin, N,N,N',N'-tetracetyl glycoluril, sodium p-acetoxybenzene sulphonate, sodium p-benzyloxy benzene sulphonate, acetyl salicylic acid, chloracetoxy salicylic acid, trimethylcyanurate and mixtures thereof.

The amount of peroxy bleach in the compositions of this invention expressed in terms of active or "available" oxygen is from 0.2% to 5.0%, preferably from 0.2% to 0.7%, more preferably from 0.2% to 0.5%, by weight of the composition. For sodium perborate tetrahydrate which contains 10.4% available oxygen, this is equivalent to from 1.92 to 48.1 wt.%, preferably from 1.92 to 6.73 wt.%, more preferably from 1.92 to 4.81 wt.%, based on the weight of the composition. For diperoxyazeleic acid which contains 14.5% available oxygen, the equivalent figures are 1.38 to 34.5 wt.%, preferably from 1.38 to 4.83 wt.%, more preferably from 1.38 to 3.45 wt.%, based on the weight of the composition.

The amount of peroxy bleach activator, when used, is at a ratio to inorganic peroxy bleach of 1:1 to about 1:20, preferably from 1:2 to 1:8.

When an inorganic peroxy bleach is used, the hydrogen peroxide which is a constituent part of the compound is believed to react according to the two equations which follow:

$$\begin{array}{l} H{-}O{-}O{-}H + {-}O{-}H^{\ominus} \xrightarrow{heat} \\ \quad H{-}O{-}O^{\ominus} + H{-}O{-}H \end{array} \qquad (1)$$

$$H{-}O{-}O{-}H \xrightarrow{metal\ ions} O{=}O + 2H{-}O{-}H \qquad (2)$$

In conventional bleaching technology, reaction (1) produces the $HOO^{\ominus}$ ion which reacts chemically with stains to oxidize and decolorize them. In contrast thereto, reaction (2) is wasteful, because it converts peroxide to molecular oxygen and water.

Reaction (1) above is known to take place to an effective extent only at relatively high temperature, above about 70° C. Where normal washing conditions take place in water cooler than about 70° C., it has been common to use a peroxy bleach activator which reacts with the $HOO^{\ominus}$ ion to form a peracetate, perbenzoate or perphthalic moiety which bleaches effectively at low temperatures. This type of reaction can be exemplified as follows:

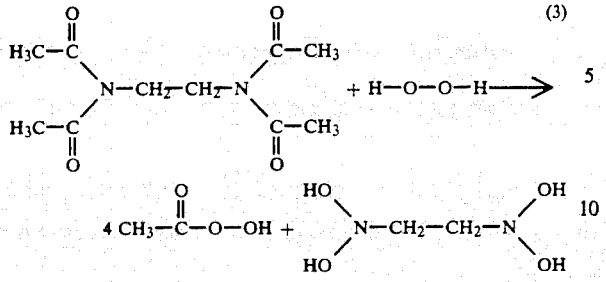

(3)

When an organic peroxy bleach is used, its anion is itself the bleach-effective moiety. It can also, however, decompose wastefully in the presence of metal ions in a manner analagous to that of hydrogen peroxide. For example,

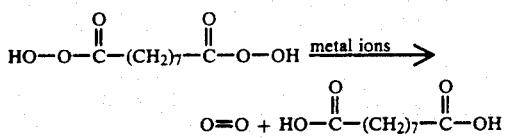

(4)

In granular or solid compositions of this invention containing an organic peroxy bleach it is desirable to include therein an exotherm control agent. Organic peroxy bleach compounds are known to decompose at elevated temperatures thereby generating heat which can result in sufficiently high temperatures to ignite the organic peroxy bleach. As taught in Hutchins et al pending patent application entitled "Peroxyacid Bleach Composition Having Improved Exotherm Control" filed Aug. 27, 1976 under U.S. Ser. No. 718,282, the stabilization of organic peroxy bleach compounds against excessive heat generation is accomplished with an exotherm control agent. As described therein an exotherm control agent is a nonhydrated material which will release from about 200% to about 500% of water based on the amount of available oxygen supplied by the organic peroxy bleach. The formation of water is the result of chemical decomposition. The exotherm control agent should start to decompose at a temperature below the decomposition temperature of the peroxy bleach compound.

The preferred exotherm control agents are those which release the requisite amount of water when present in an amount equal to about 50% or more of the amount of organic peroxy bleach compound present. A preferred amount is 50% to about 400%.

The type of material which best meets the above mentioned requirements are acids. Such acids include but are not limited to boric acid, malic acid, maleic acid, succinic acid, phthalic acid, glutaric acid, adipic acid, azelaic acid, dodecanedioic acid and the like. Preferred acids are boric acid, malic acid and maleic acid.

The third essential component of the instant invention is a porphine bleach as described hereinbelow. The structure of the compound porphine is:

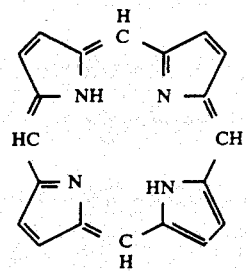

Porphine has a large closed ring designated as a macrocyclic structure, and more specifically as a quadridentate macrocyclic molecule. Porphine can be described as tetramethine tetrapyrrole, and has also been designated as porphin or porphyrin. This structure is sometimes referred to herein as the porphine 'core', because the porphine bleaches of this invention are species of substituted porphines.

One form of substitution involves substituting 1, 2, 3, or 4 aza groups (=N—) for the methine groups (=CH—) in porphine. As an example of conventional nomenclature, a compound having 3 aza groups and one methine group is referred to as triaza porphine.

Another form of substitution involves substituting for one or more of the hydrogen atoms attached to the carbon atoms in the pyrrole rings of porphine. This can be substitution by an aliphatic or aromatic group, or can be orthofused polycyclic substitution as for example to form benzene or naphthalene ring structures. The compound having the common name 'phthalocyanine' contains 4 ortho-fused benzene rings, each substituted on a pyrrole ring of the porphine core; and also contains 4 aza groups substituted for the methine groups of the porphine core; it can therefore be designated tetrabenzo tetraaza porphine, and has the structure which follows. The numbers designate the positions of pyrrole substitution according to conventional nomenclature.

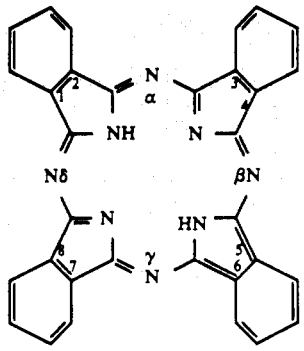

Another form of substitution involves substituting for the hydrogen of the methine groups; this is conventionally referred to as meso substitution, and the positions of substitution are conventionally designated by Greek letters as illustrated on the phthalocyanine structure above.

Still another form of substitution is metallation by a heavy metal atom in a chelation structure: replacement of the two hydrogen atoms attached to two diagonally opposite inner nitrogen atoms of the four pyrrole groups by a heavy metal atom bonded to all four inner nitrogen atoms.

Still another form of substitution is substitution of a solubilizing group into the porphine molecule.

Referring to the structure shown hereinbefore in the SUMMARY OF THE INVENTION, porphine bleaches which are effective and within the scope of this invention contain 0, 1, 2, 3 or 4 aza groups [and, according to the nomenclature defined above, contain 4, 3, 2, 1 or 0 methine groups, respectively].

The groups designated as R's in the structural formula above can, independently, be hydrogen or pyrrole substituted alkyl, cycloalkyl, aralkyl, aryl, alkaryl, or heteroaryl. Adjacent pairs of R's can also be joined together with ortho-arylene groups to form alicyclic or heterocyclic rings. Benzo substitution is especially preferred; i.e. $R_1$ and $R_2$, $R_3$ and $R_6$, and/or $R_7$ and $R_8$ are connected together pairwise by methylene groups to form fused benzene rings. Other preferred forms of pyrrole substitution are naphtho, pyrido, phenyl and naphthyl.

Substitutions can also be made for the hydrogen atoms of the methine groups of the photoactivators of this invention; thus each Y in the above structural formula can independently be hydrogen or meso substituted alkyl, cycloalkyl, aralkyl, aryl, alkaryl, or heteroaryl. It is preferred that Y is H, phenyl, naphthyl, thienyl, furyl, thioazyl, oxazyalyl, indolyl, benzothienyl, or pyridyl. No meso substitution at all or tetra phenyl meso substitution are especially preferred.

In the foregoing description, the term "alkyl" is defined to be not only a simple carbon chain but also a carbon chain interrupted by other chain-forming atoms, such as O, N or S. Non-limiting examples of such interruptions are those of the following groups:

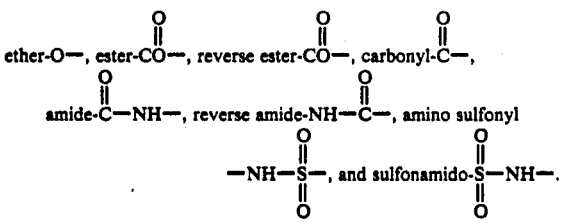

The porphine bleaches of the instant invention can be unmetallated, A in the foregoing structural formula being comprised of two hydrogen atoms bonded to diagonally opposite inner nitrogen atoms of the pyrrole groups in the molecule. Alternatively, the porphine bleaches of this invention can be metallated with zinc(II), cadmium(II), magnesium(II), calcium(II), aluminum(III), scandium(III), or tin(IV). Thus, altogether, A can be 2(H) atoms bonded to diagonally opposite N atoms, or Zn(II) Cd(II), Mg(II), Ca(II), Al(III), Sc(III) or Sn(IV). It is preferred that A be 2(H) or Zn(II).

Solubilizing groups can be located anywhere on the porphine molecule other than the porphine core as hereinbefore defined. Accordingly the solubilizing groups can be described as substituted into Y or R as hereinbefore defined.

Solubilizing groups can be anionic, nonionic, or cationic in nature. Preferred anionic solubilizing groups are carboxylate

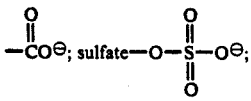

-continued

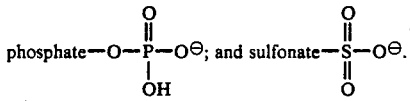

Other preferred anionic solubilizing agents are ethoxylated derivatives of the foregoing, especially the polyethoxysulfate group $—(CH_2CH_2O)_nSO_3^{\ominus}$ and the polyethoxy carboxylate group $—(CH_2CH_2O)_nCOO^{\ominus}$ where n is an integer from 1 to about 20.

For anionic solubilizing groups, M the counterion is any cation that confers water solubility to the porphine molecule. A monovalent cation is preferred, especially ammonium, ethanolammonium, or alkali metal. Sodium is most preferred. The number of anionic solubilizing groups operable in the compositions of this invention is a function of the location of such groups or the porphine molecule. A solubilizing group attached to a carbon atom of the porphine bleach molecule displaced more than 5 atoms away from the porphine core is sometimes herein referred to as "remote", and is to be distinguished from an attachment to a carbon atom displaced no more than 5 atoms from the porphine core, which is sometimes referred to herein as "proximate". For proximate solubilizing groups, the number of such groups per molecule, s, is from 3 to about 8, preferably from 3 to about 6, most preferably 3 or 4. For remote solubilizing groups, s is from 2 to about 8, preferably from 2 to about 6, most preferably 2 to 4.

Preferred nonionic solubilizing groups are polyethoxylates $—(CH_2CH_2O)_nH$. Defining s as the number of solubilizing groups per molecule, the number of condensed ethylene oxide molecules per porphine molecule is N=sn. The water soluble nonionic photoactivators of this invention have a value of N between about 8 and about 50, preferably from about 12 to about 40, most preferably from about 16 to about 30. Within that limitation the separate values of s and n are not critical.

For nonionic solubilizing groups, there is no counterion and accordingly M is numerically equal to zero.

Preferred cationic solubilizing groups are quaternary compounds such as quaternary ammonium salts

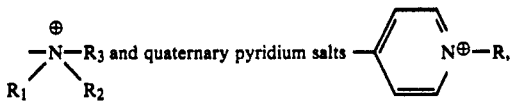

where all R's are alkyl or substituted alkyl groups.

For cationic solubilizing groups, M the counterion is any anion that confers water solubility to the porphine molecule. A monovalent anion is preferred, especially iodide, bromide, chloride or toluene sulfonate

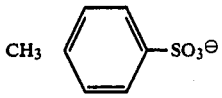

The number of cationic solubilizing groups can be from 1 to about 8, preferably from about 2 to about 6, most preferably from 2 to 4.

Usage of porphine bleach in the compositions of this invention can be from about 0.001% to about 0.5% by weight of the composition. Preferable usage is from about 0.003 to about 0.022% by weight of the composition, and especially preferred is from about 0.005 to about 0.017% by weight of the composition.

The mechanism postulated for porphine bleaches by the prior art, especially Speakman, British Pat. No. 1,372,035, and Sakkab's three disclosures, all cited hereinbefore, can be briefly described as the following sequence of events:

by the photoactivator—

Adsorption on the fabric.

Excitation by visible light to the singlet state.

Intersystem crossing to the triplet excited state.

Reaction with ground state (triplet) atmospheric oxygen to produce excited state (singlet) oxygen.

by singlet oxygen—

Chemical bleaching of the stain.

The mechanism postulated by the prior art, especially Speakman, British Pat. No. 1,408,144, for the combination of peroxy and porphine bleaches is that the porphine bleach activates, in the presence of light, not only atmospheric oxygen, but also oxygen liberated by decomposition of the hydrogen peroxide upon reaction with metal ions present in the washing solution, according to reactions (2) and (4) hereinbefore.

Howsoever, the bleaching results in darkness, which are described hereinbefore, cannot be explained on the basis of these mechanisms. According to the prior art, bleaching should not occur under these conditions. That it does in fact take place is unexpected.

By darkness is meant herein a substantially complete absence of light. A process is considered to take place in darkness even if, in automatic laundry devices, tiny gaps may be present between adjoining metal surfaces, gaskets are ill-fitted or missing, or the like; or if the laundry is moved manually in a lighted room from one substantially totally enclosed device to another.

The compositions of this invention are unexpectedly useful to persons whose normal washing process takes place in darkness, for example those using window-less automatic washers and dryers. Persons habitually doing their laundry under low-light conditions are also benefited, for example those using an automatic washer or dryer having a glass window in the door or those drying on indoor clotheslines.

Furthermore, the effectiveness of these two classes of bleaches, operating in concert, is so great that unexpectedly low amounts of peroxy bleach and/or porphine bleach are needed to achieve important, noticeable results. This achieves both economic and ecological advantages. In commercial experience, sodium perborate tetrahydrate is most commonly used at levels of about 16 to 25% by weight of the composition, and occasionally as low as 5 to 7%. Prior art suggestions for peroxy bleach/porphine bleach combinations are also in the 16–25% range. These usages correspond to available oxygen contents of most commonly 1.66 to 2.60%, occasionally 0.52 to 0.73%. They contrast with the preferred usages in the compositions of this invention as defined hereinbefore which approach as little as 0.2% available oxygen.

Similarly, remarkably low levels of porphine bleach are required. The prior art suggests, for peroxy bleach/porphine bleach combinations, zinc phthalocyanine sulfonate usages at 0.025 to 1.25 wt.% based on the composition. Levels as low as 0.001% have been suggested by the prior art for use under circumstances of a laundry soak which gives a long exposure time for adsorption of bleach upon the textiles, plus drying in sunlight. It is hence unexpected that levels in the 0.001 to 0.022% range are effective in the absence of both the long soaking time and the strong light.

The foregoing description concerns compositions containing only surfactant, peroxygen bleach, and porphine bleach, which the essential elements of this invention. They are unbuilt compositions. *Other components* are optional, as the elements of this invention are useful in a great variety of otherwise conventional compositions.

For instance, conventional alkaline detergent builders, inorganic or organic, can be used at levels up to about 80% by weight of the composition, i.e. from 0 to about 80%. For built compositions, levels from about 10% to about 60% are preferred, and levels from about 20% to about 40% are especially preferred. The weight ratio of surfactant to total builder in built compositions can be from about 5:1 to about 1:5, preferably from about 2:1 to about 1:2.

Examples of suitable inorganic alkaline detergency builder salts useful in this invention are water soluble alkali metal carbonates, borates, phosphates, polyphosphates, bicarbonates and silicates. Specific examples of such salts are sodium and potassium tetraborates, bicarbonates, carbonates, tripolyphosphates, pyrophosphates, orthophosphates, and hexametaphosphates.

Examples of suitable organic alkaline detergency builder salts are: (1) Water-soluble aminopolycarboxylates, e.g. sodium and potassium ethylenediaminetetraacetates, nitrilotriacetates and N-(2-hydroxyethyl)-nitrilodiacetates; (2) Water-soluble salts of phytic acid, e.g., sodium and potassium phytates—See U.S. Pat. No. 2,739,942; (3) Water-soluble polyphosphonates, including specifically, sodium, potassium and lithium salts of ethane-1-hydroxy-1,1-diphosphonic acid; sodium, potassium and lithium salts of methylene diphosphonic acid; sodium, potassium and lithium salts of ethylene diphosphonic acid; and sodium, potassium and lithium salts of ethane-1,1,2-triphosphonic acid. Other examples include the alkali metal salts of ethane-2-carboxy-1,1-diphosphonic acid, hydroxymethanediphosphonic acid, carbonyldiphosphonic acid, ethane-1-hydroxy-1,1,2-triphosphonic acid, ethane-2-hydroxy-1,1,2-triphosphonic acid, propane-1,1,3,3-tetraphosphonic acid, propane-1,1,2,3-tetraphosphonic acid, and propane-1,2,2,3-tetraphosphonic acid; (4) Water-soluble salts of polycarboxylate polymers and copolymers as described in U.S. Pat. No. 3,308,067.

A useful detergent builder which may be employed in the present invention comprises a water-soluble salt of a polymeric aliphatic polycarboxylic acid having the following structural relationships as to the position of the carboxylate groups and possessing the following prescribed physical characteristics: (a) a minimum molecular weight of about 350 calculated as to the acid form; (b) an equivalent weight of about 50 to about 80 calculated as to acid form; (c) at least 45 mole percent of the monomeric species having at least two carboxyl radicals separated from each other by not more than two carbon atoms; (d) the site of attachment of the polymer chain of any carboxyl-containing radical being separated by not more than three carbon atoms along the polymer chain from the site of attachment of the next carboxyl-containing radical. Specific examples of the above-described builders include polymers of itaconic acid, aconitic acid, maleic acid, mesaconic acid, fumaric acid, methylene malonic acid and citraconic acid and copolymers with themselves.

In addition, other polycarboxylate builders which can be used satisfactorily include water-soluble salts of mellitic acid, citric acid, pyromellitic acid, benzene pentacarboxylic acid, oxydiacetic acid, carboxymethyloxysuccinic acid and oxydisuccinic acid.

Certain zeolites or aluminosilicates enchance the function of the alkaline metal pyrophosphate and add building capacity in that the aluminosilicates sequester calcium hardness. One such aluminosilicate which is useful in the compositions of the invention is an amorphous water-insoluble hydrated compound of the formula $Na_x(xAlO_2.SiO_2)$, wherein x is a number from 1.0 to 1.2 and y is 1, said amorphous material being further characterized by a $Mg^{++}$ exchange capacity of from about 50 mg eq. $CaCO_3$/g. to about 150 mg eq. $CaCO_3$/g. and a particle diameter of from about 0.01 microns to about 5 microns. This ion exchange builder is more fully described in British Pat. No. 1,470,250 invented by B. H. Gedge et al, published Apr. 14, 1977, herein incorporated by reference.

A second water-insoluble synthetic aluminosilicate ion exchange material useful herein is crystalline in nature and has the formula $Na_z[AlO_2)_z\cdot(SiO_2)]xH_2O$, wherein z and y are integers of at least 6; the molar ratio of z to y is in the range from 1.0 to about 0.5, and x is an integer from about 15 to about 264; said aluminosilicate ion exchange material having a particle size diameter from about 0.1 micron to about 100 microns; a calcium ion exchange capacity on an anhydrous basis of at least about 200 milligrams equivalent of $CaCO_3$ hardness per gram; and a calcium ion exchange rate on an anhydrous basis of at least about 2 grains/gallon/minute/gram. These synthetic aluminosilicates are more fully described in British Pat. No. 1,429,143 invented by Corkill et al, published Mar. 24, 1976, herein incorporated by reference.

For nominally unbuilt compositions, it is contemplated that compositions can contain minor amounts, i.e. up to about 10%, of compounds that, while commonly classified as detergent builders, are used primarily for purposes other than reducing free hardness ions; for example electrolytes used to buffer pH, add ionic strength, control viscosity, prevent gelling, etc.

It is understood that the compositions of the present invention can contain other components commonly used in detergent compositions. Soil suspending agents such as water-soluble salts of carboxy methylcellulose, carboxymethylhydroxyethylcellulose, copolymers of maleic anhydride and vinyl ethers, and polyethylene glycols having a molecular weight of about 400 to 10,000 are common components of the detergent compositions of the present invention and can be used at levels of about 0.5% to about 10% by weight. Other soil suspending agents that can be used are glassy phosphates as disclosed in Belgian patent 838,751 and aluminosilicates and precipitated silicas as disclosed in Jones, Canadian patent applications No. 293,605 filed on Dec. 21, 1977.

Other materials such as fluorescers, colorants, perfumes, antiseptics, germicides, enzymes in minor amounts, and anti-caking agents such as sodium sulfosuccinate and sodium benzoate may also be added. Other materials useful in detergent compositions are clay, especially the smectite clays disclosed in U.S. Pat. No. 3,915,882, suds depressants, fillers such as sodium sulfate, pH buffers, and hydrotropes such as sodium toluene sulfonate and urea.

Granular formulations embodying the compositions of the present invention may be formed by any of the conventional techniques i.e., by slurrying the individual components in water and then atomizing and spray-drying the resultant mixture, or by pan or drum granulation of the components. A preferred method of spray drying compositions in granule form is disclosed in U.S. Pat. Nos. 3,629,951 and 3,629,955 issued to Davis et al on Dec. 28, 1971.

Liquid detergents embodying the compositions of the present invention can be unbuilt or can contain builders. They ordinarily contain organic rather than inorganic peroxy bleaches. If unbuilt, they can contain about 10 to about 50% surfactant, up to about 15% of an organic base such as mono-, di-, or tri-alkanolamine, and a solubilization system containing various mixtures of water, lower alcohols and glycols, and hydrotropes. Built liquid single-phase compositions can contain about 10 to about 25% surfactant, from about 10 to about 20% builder which can be inorganic or organic, about 3 to about 10% hydrotrope, and water. Built liquid compositions in multi-phase heterogeneous form can contain comparable amounts of surfactant and builder together with viscosity modifiers and stabilizers to maintain stable emulsions or suspensions.

Compositions in the form of detergent laundry bars can be prepared as described in U.S. Pat. No. 3,178,370 issued Apr. 13, 1965 and British Pat. No. 1,064,414 issued Apr. 5, 1967, both to Okenfuss and both herein incorporated by reference. A preferred process, called "dry neutralization", involved spraying the surfactant in liquid, acid form upon an agitated mixture of alkaline components such as phosphates and carbonates, followed by mechanically working as by milling, extruding as in a plodder, and forming into bars.

The compositions of this invention can also be incorporated if desired into substrate articles. These articles consist of a water-insoluble substrate which releasably incorporates an effective amount, preferably from about 3 to about 120 grams, of the compositions described herein.

Formulations embodying the compositions of the present invention are commonly used in laundry practice at product concentrations from about 0.1 to about 0.6 wt.% in water. Within these approximate ranges are variations in typical usage from household to household and from country to country, depending on washing conditions such as the ratio of fabric to water, degree of soiling of the fabrics, temperature and hardness of the water, method of washing whether by hand or by machine, specific formulation employed, etc.

It has been stated hereinbefore that peroxy bleach usage is from 0.2% to 5.0%, preferably from 0.2% to 0.7%, on an available oxygen basis; also that porphine bleach usage is from 0.001% to 0.5%, preferably from 0.003% to about 0.022%; where all figures are by weight of the composition. Combining those figures with the foregoing product concentrations yield the result that peroxy bleach concentrations in water, expressed in terms of available oxygen, range from about 2 to about 300 parts per million (ppm). Within this range, from about 10 to about 40 ppm are preferred. Porphine bleach concentrations in water range from about 0.01 to about 30 ppm, while from about 0.05 to about 1.5 ppm are preferred.

EXAMPLE I

Compositions were prepared as follows:

| Composition No. | [1] | [3] | [5] | [9] |
|---|---|---|---|---|
| Component (Wt. %) | | | | |
| $C_{11.8}$ linear alkyl benzene sulfonate | 24.0 | 8.5 | 8.5 | 5.8 |
| tallow alkyl sulfate | — | — | — | 2.5 |
| nonionic surfactant[a] | — | 3.0 | 3.0 | 3.1 |
| hydrogenated fish oil fatty acid[b] | — | 3.0 | 3.0 | 3.7 |
| coconut monoethanol amide | 1.54 | — | — | — |
| sodium tripolyphosphate | 36.2 | 44.0 | 38.0 | 27.0 |
| sodium silicate solids | 8.0[c] | 6.0[c] | 6.0[c] | 8.2[d] |
| sodium perborate tetrahydrate | 7.1 | 12.0 | 18.0 | 32.5 |
| sodium sulfate | 13.9 | 10.0 | 10.8 | 8.3 |
| optical brightener | 0.24 | 0.30 | 0.30 | 0.23 |
| proteolytic enzyme | 0.32 | 0.60 | 0.60 | 0.22 |
| ethylene diamine tetraacetic acid | — | — | — | 0.21 |
| carboxymethyl cellulose | 0.36 | 0.76 | 0.76 | 0.89 |
| polyethylene glycol | 0.25[e] | 0.25[e] | 0.25[e] | 0.25[f] |
| color | 0.03 | 0.02 | 0.01 | — |
| perfume | 0.15 | 0.15 | 0.18 | 0.17 |
| water | 7.4 | 9.1 | 9.7 | 5.7 |
| miscellaneous | balance | bal. | bal. | bal. |
| | 100 | 100 | 100 | 100 |

[a]tallow fatty alcohol ethoxylated with an average of 11 mols ethylene oxide per mole of alcohol
[b]over 70% $C_{16} + C_{18}$
[c]3.2 ratio $SiO_2/Na_2O$
[d]2.0 ratio $SiO_2/Na_2O$
[e]molecular weight 600
[f]molecular weight 400

Composition [2] was prepared like composition [1] except that 0.007% zinc phthalocyanine tetrasulfonate, tetrasodium salt was added. This was prepared by condensing phthalonitrile and zinc dust in the presence of molybdic acid, followed by sulfonation with oleum according to the method of U.S. Pat. No. 4,033,718.

Compositions [1] and [2] were used to wash soiled family laundry in a commercial JATA upright-style automatic washer having a metal lid which was closed during the washing cycle. Water temperature was 35° C.; water hardness 15 grains per U.S. gallon; and washing time 10 minutes. For certain tests identified below a 3-hour soaking period using the same kind of water preceded washing. The ratio of soiled fabrics to water was 1/27 by weight. Product concentration was 0.37% in the soak, if present, and 0.32% in the wash.

Clean white cotton swatches and cotton and polycotton stained swatches were added to the soiled clothes in each washer load. Stained swatches were of two kinds: (a) tea, which were prepared by boiling swatches in a 1.1% tea solution for 30 minutes, followed by rinsing and drying, and (b) mixed foods, which were prepared by similarly boiling swatches in an aqueous solution containing 2.7% instant coffee, 5.8% strawberry jam, 10.2% milk, 13.6% sugar, and 13.6% red wine. Swatches were replicated 4 times and judged by a panel of graders on a visual Scheffe scale.

After washing, the artificial illumination of the laundry room was extinguished and the clothes and swatches were transferred manually from the washer to an automatic electric dryer. The glass window in the door was covered by black pepper to substantially preclude the admission of light.

Whiteness and stain removal performance of Composition [2], an example of this invention, as compared with that of control Composition [1] was as shown below. All units are panel score units and the 90% statistical yardstick is given in parentheses for each test, with statistically significant comparisons identified with an asterisk.

| fabric | stain | stain removal (wash) | stain removal (soak and wash) |
|---|---|---|---|
| cotton | none | +1.37* (1.02) | +1.64* (1.28) |
| cotton | tea | −0.15 (.71) | +0.92* (.78) |
| cotton | mixed foods | +1.07* (.84) | +1.27* (.98) |
| polycotton | tea | +0.30 (.81) | +0.92* (.78) |
| polycotton | mixed foods | +0.55 (.78) | +0.17 (.68) |

In most instances Composition [2] of this invention was superior to that of control Composition [1]. Superiority was greater for cotton fabric as compared with polycotton and for the soak and wash treatment as compared with washing only.

Compositions [1] and [2] were also tested using a procedure like that described hereinbefore except that drying took place in the sunlight out of doors; product concentrations were 0.26% in both the soak and wash; water hardness was 4 grains per U.S. gallon; soaking time, if used, was 2 hours, and the washing machines were commercial BRU top loading machines identified as model numbers B-32 and Super A-51. There are no windows in either model.

In the following tests. Composition [2] was statistically superior: soak and wash using cotton swatches: unstained, grease stain, cocoa/milk stain, and tea/mixed foods stain; using polycotton swatches: tea/mixed foods stain; wash only using cotton swatches unstained and grease stain. Composition [2] was directionally but not statistically superior in the following tests: using cotton swatches: cocoa/milk stain and tea/mixed foods stain; using polycotton swatches: tea/mixed foods stain. In none of this series of tests was composition [1] superior to composition [2], even directionally.

Composition [4] was prepared like composition [3] except that 0.007% zinc phthalocyanine sulfonate, tetrasodium salt was added. Tests were run as described hereinbefore, except that the machines used were a Kelvinator K-2806 having a 20-minute soak cycle and a BALAY T-548 having a 30-minute soak cycle. Half the swatches were washed in each machine, and the results combined. Both machines are front loading machines with windows in the doors; for the test described hereinbelow the windows were left uncovered. Stain removal performance of Composition [4], an example of this invention, in comparison with that of control Composition [3] was as follows:

| fabric | stain | stain removal (wash) |
|---|---|---|
| cotton | tea | +2.16* (1.64) |
| cotton | mixed foods | +0.41 (2.21) |
| polycotton | tea | +1.08* (0.93) |
| polycotton | mixed foods | +1.29* (0.58) |

As before, the composition containing both perborate and porphine bleach exhibited superior properties of stain removal.

Aqueous solutions were prepared of composition [5] and also composition [5] to which zinc phthalocyanine sulfonate, tetrasodium salt was added in an amount equivalent to 0.007% on a composition basis. Tests were run as described hereinbefore, except that water temperature was 40° C.; water hardness 15 grains per U.S. gallon; washing time 90 minutes; product concentrations 0.5% for the soak, 0.8% for the wash. Machines used were the KELVINATOR K-2806 and BALAY T-548 described hereinbefore; for the tests described below the windows were covered with black paper, as was the window of the PETITE automatic electric dryer, and the laundry transfer from washer to dryer took place with the lights extinguished.

Stain removal performance of the solution containing zinc phthalocyanine sulfonate, tetrasodium salt, as compared to that of the control solution, was as follows:

| fabric | stain | stain removal (wash) |
|---|---|---|
| cotton | tea | +1.62* (.76) |
| cotton | mixed foods | +1.56* (.88) |
| polycotton | tea | +2.71* (.45) |
| polycotton | mixed foods | +0.99* (.36) |

The solution containing porphine bleach was significantly better than the control solution in every instance.

Composition [6] is prepared like composition [5] except that 0.007% of zinc phthalocyanine sulfonate, tetrasodium salt, is added. Tests as described supra show Composition [6] of this invention to be superior to Composition [5] to a degree comparable to that shown in the preceding table.

Aqueous solutions were prepared that correspond to composition [5] except that they contained sodium perborate tetrahydrate in amounts corresponding to 15% and 13.5%, respectively, on a composition basis. Both solutions also contained 0.007% zinc phthalocyanine sulfonate, tetrasodium salt, on a composition basis. The solution containing 15% perborate and porphine bleach was statistically superior in stain removal to the solution of composition [5] under all conditions described in the foregoing test. While the stain removal performance of the solution containing 13.5% perborate could not be distinguished from that of the solution of Composition [5] under those test conditions, it was directionally superior thereto under all conditions except tea stains on cotton.

Compositions [7] and [8] are prepared like Composition [6] except that their levels of sodium perborate tetrahydrate were 15% and 13.5%, respectively. The stain removal performance of each of the compositions is compared to that of the corresponding solutions described supra.

The above tests on solutions of Composition [5] and Composition [5] containing 0.007% zinc phthalocyanine sulfonate, tetrasodium salt, were repeated under different washing conditions: temperatures ranging from 40° to 90° C., water hardness from 7 to 24 grains per U.S. gallon; washing times from 50 to 90 minutes; product concentrations from 0.5 to 1.3%; drying with and without a black paper cover on the window of the electric dryer. Results were comparable to those described hereinbefore, with the solutions containing porphine bleach consistently outperforming the control. When fabrics were dried outdoors in the sunlight, this superiority increased about 0.5 panel score units or the average.

Aqueous solutions were prepared of Composition [9] and also Composition [9] to which 0.007% zinc phthalocyanine sulfonate, tetrasodium salt, was added by admixing a blue sodium tripolyphosphate speckle containing the photoactivator. The two solutions were tested at 60° C. and at 90° C. at usages corresponding to product concentrations of 0.8% in water having 11 grains hardness per U.S. gallon, using Zanussi REX SL-50 commercial front loading washing machine. The window on the washer door was not covered. The fabrics were dried in an electric dryer having no window. Washing soiled fabrics obtained from consumer households, a significant advantage was observed for the solution containing porphine bleach as compared with the solution of Composition [9] on pillow cases, terry cloth towels, and undershirts at both temperatures, and on kitchen towels at 60° C. The solution of composition [9] was not superior on any fabrics of this type. Washing stained swatches prepared in the laboratory, the solution containing porphine bleach was significantly superior to the solution of Composition [9] for grass stain at 90° C., lipstick at 90° C., dirty motor oil at 90° and 60° C., tea at 60° C., wine at 60° C., and coffee at 60° C. No statistically significant differences were observed for shoe polish, makeup, blood, tomato or cocoa stains, though they collectively showed directional advantages for the solution containing porphine bleach in 8 out of the 10 comparisons.

Composition [10] is prepared like Composition [9] except that 0.007% zinc phthalocyanine sulfonate, tetrasodium salt, is added. Stain removal tests as described supra show Composition [10] to be superior to Composition [9] to a degree comparable to that described above for the corresponding solutions.

Composition [11] is prepared like composition [1] except that 0.010% aluminum phthalocyanine tetrasulfonate, tetrasodium salt is added. This material is prepared by a method analogous to that of the corresponding Zn derivative; i.e. using Al rather than Zn dust. Stain removal tests show composition [11] to be more comparable to composition [2] than to composition [1].

Composition [12] is prepared like composition [1] except that 0.010% calcium phthalocyanine tetrasulfonate, tetrasodium salt is added. This material is prepared by a method analogous to that of the corresponding Zn derivative; i.e. using Ca rather than Zn dust. Stain removal tests show composition [12] to be more comparable to composition [2] than to composition [1].

Other porphine bleaches have been prepared according to the methods of Sakkab, cited hereinbefore:

(pa) $\alpha, \beta, \gamma, \delta$—tetrakis (4-carboxyphenyl) porphine, tetrasodium salt (pb) $\alpha, \beta, \gamma, \delta$—tetrakis (4-carboxyphenyl) porphine zinc, tetrasodium salt $\alpha, \beta, \gamma, \delta$—tetrakis (4-carboxyphenyl) porphine was prepared by refluxing a propionic acid solution, 0.24 molar in both 4-carboxybenzaldehyde and pyrrole, for 2 hours. Upon cooling the reaction mixture, purple crystals of $\alpha, \beta, \gamma, \delta$—tetrakis (4-carboxyphenyl) porphine precipitated. Yield was 32%. The product was purified by recrystallization from methanol/chloroform solutions.

Metallation was accomplished as by reacting tetrakis(4-carboxyphenyl) porphine with an excess of zinc acetate in refluxing dimethyl formamide, removing the solvent on a rotavaporator to obtain a residue dissolving the residue in water, acidifying to pH 3, and passing through the $H^{\oplus}$ form of the cation exchange resin Dowex 5DW-X8(50-100 mesh) to remove the excess ionic zinc. The residue after evaporation yielded a red crystalline product with about 98% yield.

The acid form of photoactivator, prepared as described above, was converted to the tetra sodium salt upon addition to alkaline (pH ~10) detergent solution, the cations of which were predominantly sodium.

(pc) α, β, γ, δ—tetrakis (4-N-methyl pyridyl) porphine, tetra (4-toluene sulfonate) salt (pd) α, β, γ, δ—tetrakis (4-N-methyl pyridyl) porphine zinc, tetra (4-toluene sulfonate) salt α, β, γ, δ—tetrakis (4-N-methyl pyridyl) porphine, tetra (4-toluene sulfonate) salt was prepared by refluxing a propionic acid solution which was equimolar in pyridine 4-carboxaldehyde and pyrrole. The solvent was flashed off and the residue was washed with dimethylformamide to dissolve the tarry by-products leaving purple crystals of tetra (4-pyridyl) porphine. Yield was 22.5%.

The tetra (4-pyridyl) porphine was then refluxed with sodium 4-toluene sulfonate overnight in dimethyl formamide. The reaction was then cooled in an ice bath and the product was removed by filtration. The collected violet crystals of α, β, γ, δ—tetra (N-methyl pyridyl) porphine, tetra 4-toluene sulfonate salt were washed with acetone and dried under vacuum. Yield was 92%.

Metallation was accomplished in a manner similar to that described above for the tetracarboxy phenyl porphine described supra, with purification accomplished by chromatographic chloroform solutions on alumina. The metallation was done prior to quaternization with 4-toluene sulfonate.

(pe) Tetra (2-sulfatoethyl sulfonamido benzo) tetraaza porphine zinc, tetrasodium salt Tetra (2-sulfatoethyl sulfonamido benzo) tetraaza porphine zinc, tetrasodium salt was prepared by heating tetrasulfo tetrabenzo tetraaza porphine zinc, tetrasodium salt to 60° C. with chlorosulfonic acid and agitation. At this temperature, thionyl chloride was added dropwise and the mixture was then heated for 4 hours at 80° C. The reaction mixture was then cooled and added with agitation to cold water from which the tetrachloro sulfo tetrabenzo tetraaza porphine zinc was separated by filtration and subsequently washed with cold water. The tetrachlorosulfo tetrabenzo tetraaza porphine paste was then suspended in cold water and mixed with 2-an inoethanol for 20 hours at 20° C. The suspension was then acidified with hydrochloric acid to obtain a precipitate which was separated by filtration, washed with water and dried. Twenty parts of the already obtained ethanolsulfonamide derivative of tetrabenzo tetraaza porphine zinc were then mixed at 20° C. with 10% oleum. The solution was then poured in a solution of sodium chloride into water, and ice was added. A blue/gree precipitate was formed and was separated by filtration and was washed with a solution of sodium chloride in water and ethyl alcohol until it was neutral to Congo red. The blue/green powder obtained was then dried at 105° C. for 2 hours. The product was purified by six successive precipitations from aqueous solution by the addition of four volumes of acetone. Yield was 28%.

(pf) Tetrasulfobenzo triaza porphine, tetrasodium salt

Tetrabenzo triaza porphine was prepared as follows: A solution of methyl magnesium iodide was prepared from magnesium and methyl iodide in ether; this was decanted from the residual metal and added to a mixture of finely powdered phthalonitrile and ether. Upon addition, the liquid at once turned reddish-brown, the nitrile dissolving, the ether gently boiling, and a tarry mass forming. After three hours at room temperature, the remainder of the ether was removed on a steam bath and the tarry residue was rapidly heated to 200° C. Three ml. of $H_2O$ were added dropwise, liberating first white fumes and then iodine vapor. After a further ½ hour at 200° C., the powdery residue was cooled, crushed and repeatedly extracted with a mixture of alcohol and 10% concentrated hydrochloric acid until the extract was no longer brown in color. The residue was then washed with absolute ethanol and dried in an oven at 105° C. for one hour. The product was freed from magnesium by dissolving it in concentrated sulfuric acid, followed by filtration and precipitation of the pigment with ice. The green precipitate was then collected on a filter and was washed with hot water containing 5% ammonium hydroxide. It was then dried at 105° C. and crystallized from chloronaphthalene. Yield was 4.2 gm. of tetrabenzo triaza porphine in the form of purple needle-like crystals.

Tetrabenzo triaza porphine was metallated to tetrabenzo triaza porphine zinc by the following process: reagent grade N,N' dimethylformamide was brought to reflux on a stirring hot plate. Tetrabenzo triaza porphine was then added, 1 minute allowed for complete solution to occur, and then a 10% excess of the stoichiometric amount of zinc acetate was added and reaction was allowed to proceed under reflux for one hour. The reaction vessel was then removed from the hot plate and cooled in an ice-water bath for 15 minutes. Chilled distilled water was then added, and the resulting partially crystalline precipitate was filtered, washed with water, and air-dried. The product was then recrystallized from chloronaphthalene. Yield was 1.9 gm. in the form of purplish crystals.

Sulfonation of tetrabenzo triaza porphine zinc led to the compound tetrasulfobenzo triaza porphine, tetrasodium salt, with demetallation occuring simultaneously: Tetrabenzo triaza porphine zinc and concentrated $H_2SO_4$ were ground together into a homogeneous paste with a mortar and pestle. Additional concentrated $H_2SO_4$ was admixed, and the mixture was heated on a steam bath for 4 hours, removed and allowed to stand at room temperature for 48 hours, and filtered to remove unreacted pigment. The filtrate was then diluted with two volumes of $H_2O$ to precipitate the bright green $HSO_4^-$ salt of the sulfonated material, which was filtered and washed with acetone and then dissolved in alkaline methanol. The sulfonated porphine was then precipitated as the sodium salt by addition of 3 volumes of acetone. After the product was then dried, it was extracted with hot methanol to remove $Na_2SO_4$ residues. After extraction, the porphine was dissolved in $H_2O$, acidified to pH 3, and passed through the $H^+$ form of the cation exchange resin Dowex 50W-X8 (50-100 mesh) to remove ionic zinc. Pure tetrasulfobenzo triaza porphine in the form of a fine green powder was then isolated from a pH 5 solution by the addition of four volumes of acetone.

(pg) Tetra (4-sulfophenyl) porphine, tetraamonium salt (ph) Tetra (4-sulfophenyl) porphine zinc, tetrasodium salt Tetra(4-sulfophenyl) porphine, tetraamonium salt was prepared as follows: Tetraphenyl porphine, obtained from the Aldrich Chemical Company, Milwaukee, Wisconsin, U.S.A., was sulfonated in the manner described supra for tetrabenzo triaza porphine with the exception that neutralization was done with methanolic ammonia (5%). Yield was 2.5 gm. of tetra(4-sulfophenyl) porphine tetraamonium salt.

Metallation was accomplished in a manner similar to that described under item (pf) supra. One gram of tetra(4-sulfophenyl) porphine, tetraamonium salt was reacted with a 10% excess of zinc acetate in refluxing dimethyl formamide for one hour. However isolation of the product was accomplished by a different procedure. After completion of the reaction, the solvent was removed on a rotavaporator to obtain a residue. This residue was dissolved in water, acidified to pH 3, and passed through the H+ form of the cation exchange resin Dowex 50W-X8 (50–100 mesh) to remove the excess ionic zinc. As the solution passed through the resin, it was immediately neutralized with sodium hydroxide to avoid decomposition of the acidic compound to zinc ions and the unmetallated porphine sulfonate. Yield was 0.96 g. tetra(4-sulfophenyl porphine zinc, tetrasodium salt.

EXAMPLE II

Eighteen exemplary compositions of this invention are identified on Table I. All contain combinations of surfactant, peroxy bleach, and porphine bleach within the scope of this invention. The individual components of these compositions are identified in the footnotes which follow the table. Composition numbers 5, 12 and 15 are in liquid form, and the balance of each composition is water. The remaining compositions are in solid form, and each composition contains 10% water with the balance sodium sulfate.

These compositions are tested in the manner described in Example I. Washing temperatures are 90° C. for compositions 2, 3, 9, 12, 14 and 17, and 40° C. for the remainder. In each case fabrics washed in the composition of this invention show substantially greater stain removal than fabrics washed in compositions omitting either peroxy bleach or porphine bleach.

TABLE I

| Composition No. | Wt.% Surfactant | | Peroxy Bleach Av. Ox. | | Porphine Bleach | | Peroxy Bleach Activator | | Builder | | Other Components | |
|---|---|---|---|---|---|---|---|---|---|---|---|---|
| 1 | 5% | Sa | 4.5% | Pa | 0.004% | pf | 1.5% | Aa | 30% | Ba | 1% | Oa |
| 2 | 40 | Sb | 0.2 | Pe | 0.010 | pa | | | | | | |
| 3 | 25 | Sc | 2.5 | Ph | 0.10 | pl | | | 10 | Bj | 0.1 | Ob |
| 4 | 10 | Sd | 0.5 | Pi | 0.022 | pg | | | 70 | Ba | 10 | Oc |
| | | | | | | | | | 10 | Bh | 0.05 | |
| | | | | | | | | | | | Og | |
| 5 | 16 | Se | 4.0 | Pg | 0.001 | pb | 15 | Ab | | | 10 | Oc |
| 6 | 24 | Sf | 0.6 | Pn | 0.50 | pc | | | 40 | Bd | 0.5 | Oa |
| | | | | | | | | | | | 0.1 | Of |
| 7 | 26 | Sg | 0.4 | Pb | 0.013 | pk | 1.0 | Ae | 20 | Bb | 0.5 | Ok |
| 8 | 50 | Sh | 3.5 | Pj | 0.003 | po | | | | | 0.5 | Od |
| 9 | 20 | Si | 0.7 | Pd | 0.007 | pm | | | 44 | Bc | 2 | Oc |
| | | | | | | | | | 6 | Bf | | |
| 10 | 18 | Sj | 2.0 | Pm | 0.002 | ph | | | 15 | Bb | 0.2 | Oe |
| | | | | | | | | | 10 | Bi | 1.0 | Oj |
| 11 | 35 | Sk | 0.6 | Po | 0.04 | po | | | 40 | Bg | 0.2 | Ob |
| 12 | 12 | Sl | 3.0 | Pc | 0.30 | pn | | | | | 8 | Oc |
| 13 | 30 | Sm | 1.5 | Pk | 0.005 | pd | | | 25 | Ba | 10 | Oh |
| | | | | | | | | | 10 | Bf | | |
| 14 | 45 | Sn | 0.3 | Pf | 0.20 | pj | | | | | 0.01 | Of |
| | | | | | | | | | | | 12 | Oc |
| 15 | 15 | So | 5.0 | Pl | 0.017 | pq | | | | | 0.1 | Oe |
| 16 | 6 | Sc | 0.3 | Pf | 0.004 | pr | 1.0 | Ac | 14 | Bg | | |
| | 6 | Sf | | | | | | | 6 | Bf | | |
| 17 | 10 | Sa | 3.5 | Pb | 0.02 | Pe | | | | | | |
| | 5 | Sg | | | | | | | | | | |
| 18 | 12 | Sj | 0.5 | Pe | 0.40 | pi | 3.0 | Ad | 30 | Bd | 3 | Ok |
| | 8 | Sk | | | | | | | 30 | Be | | |

Footnotes to Table I:

Surfactants

Sa $C_{12}$ branched chain alkyl benzene sulfonate (ABS), sodium salt

Sb $C_{12}$ linear alkyl benzene sulfonate (LAS), sodium salt

Sc coconut alkyl sulfate, sodium salt

Sd ethyl ester of $C_{18}$ alpha sulfocarboxylate, sodium salt

Se tallow soap

Sf alkyl polyethoxy alcohol sulfate having 11 carbon atoms in the alkyl group and 2 mols ethylene oxide per mol of alcohol, sodium salt Sg alkyl polyethoxy alcohol having 16 carbon atoms in the alkyl group and 25 mols ethylene oxide per mol of alcohol Sh polyethoxy polypropoxy glycol having a molecular weight of 5000, half of which represents the polypropoxy base and half of which represents hydrophilic polyethoxylate Si dimethyl $C_{12}$ amine oxide Sj $C_{16}$ alkyl dimethyl ammonio propane sulfonate Sk coconut alkyl trimethyl ammonium chloride Sl ditallow dimethyl ammonium chloride Sm trioctyl methyl ammonium chloride Sn stearoyl choline ester quaternary ammonium bromide $$\text{So}\ Br^{\ominus}\ (CH_3)_3-N^{\oplus}-(CH_2)_2-O-\overset{O}{\overset{\|}{C}}-(CH_2)_{12}-\overset{O}{\overset{\|}{C}}-O-(CH_2)_2-N^{\oplus}-CH_3)_3\ Br^{\ominus}$$

Peroxy Bleach:

(Pa) sodium perborate monohydrate
(Pb) potassium perborate tetrahydrate
(Pc) sodium perborate tetrahydrate
(Pd) potassium perborate monohydrate
(Pe) potassium percarbonate
(Pf) potassium monopersulfate
(Pg) sodium perphosphate
(Ph) urea peroxide
(Pi) diperazelaic acid
(Pj) diperdodecanedioic acid
(Pk) monoperoxy phthalic acid (Pl) m-chloroperoxy benzoic acid
(Pm) p-nitroperoxy benzoic acid
(Pn) diperoxyisophthalic acid
(Po) diperoxy terephthalic acid Porphine Bleach:

Bleaches (pa) through (ph) are identified hereinbefore. The remainder are as follows:

(pi) benzotrisulfobenzo monoaza porphine magnesium, trilithium salt
(pj) tetrasulfobenzo diaza porphine scandium, tetra(ethanolamine) salt
(pk) trans-dichloro, trisulfobenzo-tri(sulfo-2-pyridyl)-2-pyridyl porphine tin(IV), hexapotassium salt
(pl) 1,2,3,4,5,6,7,8-octasulfophenyl porphine cadmium, octasodium salt
(pm) tetrabenzo-α, β, γ, δ-tetrakis (4-N-methyl) pyridyl porphine tetraiodide
(pn) 1,3,5,7-tetrakis (sulfato polyethoxy phenyl)-α, β, γ, δ-tetrakis (phosphato napthyl) porphine, octapotassium salt
(po) trans dichloro, di(N-methyl pyrido)-α, β, γ, δ-tetrakis (carboxyphenyl) porphine tin (IV), tetraammonium salt
(pp) 1,3,5-tri(4-polyethoxy)-α, β, γ-tri-(4-polyethoxy)-δ-aza-porphine
(pq) bromo, tetrabenzo-α-(4-N-methyl) pyridyl-β, γ, δ-pyridyl porphine scandium monobromide
(pr) 2,4,6,8-tetrakis (sulfophenyl-n-heptyl) tetraaza porphine, tetra (monoethanolamine) salt Peroxy Bleach Activators:

(Aa) N,N,N',N'-tetraacetyl ethylene diamine
(Ab) triacetyl cyanurate
(Ac) tetraacetyl glycoluril
(Ad) N-acetyl imidazole
(Ae) sodium-p-acetoxy benzene sulfonate Builders Ba sodium tripolyphosphate
Bb sodium pyrophosphate
Bc sodium nitrilotriacetate
Bd citric acid
Be sodium carbonate
Bf sodium silicate solids, 2.0 ratio $SiO_2Na_2O$
Bg sodium aluminosilicate $Na_{12}(AlO_2.SiO_2)_{12}.27\ H_2O$
Bh potassium tetraborate
Bi sodium orthophosphate
Bj ethane-1-hydroxy-1,1-diphosphonate, sodium salt Other Components Oa polyethylene glycol, molecular weight 6000
Ob perfume
Oc potassium toluene sulfonate
Od sodium carboxymethylcellulose
Oe optical brightener (fluorescer)
Of colorant
Og protease
Oh montmorrilonite clay
Oi Gantrez AN, an equimolar copolymer of maleic anhydride and vinyl methyl ether, manufactured by the GAF Corp.
Oj "Glass H", a glassy phosphate having the formula $Nax_{23}P_{21}O_{64}$ manufactured by the FMC Corp.
Ok "Zeosyl 110SD", a precipitated silica manufactured by the J. M. Huber Corp.

EXAMPLE III

The following granular composition is prepared.

| | |
|---|---|
| $C_{11.8}$ linear alkyl benzene sulfonate, Na salt | 4% |
| Diperdodecanedioic acid (76% active) | 21 |
| Boric acid (anhydrous) | 21 |
| Zinc phthalocyanine tetrasulfonate, tetrasodium salt | 0.01 |
| Sodium sulfate | 51 |
| Optical brightener | 0.6 |
| Mineral oil | 1 |
| Minors (carboxymethylcellulose, bluing, perfume, etc.) and miscellaneous | 1.4 |
| | 100 |

What is claimed is:

1. A process for removing stains from cotton fabrics which comprises the steps of (i) treating the fabrics with an aqueous solution of detergent bleach composition, and (ii) drying; wherein both steps take place in darkness and wherein said detergent bleach composition consists essentially of the following components, (a) surfactant, (b) peroxy bleach, and (c) porphine bleach;

where the surfactant is from 5 to 50 wt. % based on the weight of the composition and is selected from the group consisting of anionic, nonionic, semipolar, ampholytic and cationic surfactants;

where the peroxy bleach has an available oxygen content of from 0.2 to 5.0 wt. % based on the weight of the composition and is an inorganic peroxyhydrate selected from the group consisting of alkali metal salts of perborates, percarbonates, persulfates, persilicates, perphosphates and perpolyphosphates; urea peroxide; or an organic peroxy acid or anhydride or salt thereof having the general formula

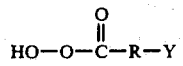

where R is an alkylene group containing from 1 to 20 carbon atoms or a phenylene group and Y is selected from the group consisting of hydrogen, halogen, alkyl and aryl;

where the porphine bleach is from 0.001 to 0.5 wt. % based on the weight of the composition and has the general formula

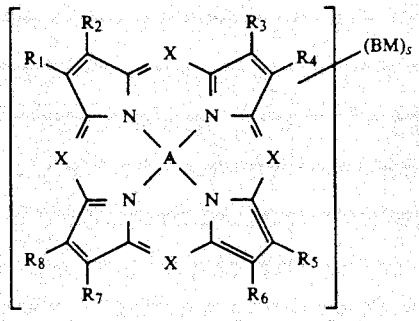

wherein each X is (=N—) or (=CY—), and the total number of (=N—) groups is 0, 1, 2, 3 or 4; wherein each Y, independently, is hydrogen or meso substituted alkyl, cycloalkyl, aralkyl, aryl, alkaryl or heteroaryl; wherein each R, independently, is hydrogen or pyrrole substituted alkyl, cycloalkyl, aralkyl, aryl, alkaryl or heteroraryl, or wherein adjacent pairs of R's are joined together with orthoarylene groups to form pyrrole substituted alicyclic or heterocyclic rings; wherein A is 2(H) atoms bonded to diagonally opposite nitrogen atoms, or Zn(II), Cd(II), Mg(II), Ca(II), Al(III), Sc(III), or Sn(IV); wherein B is an anionic, nonionic or cationic solubilizing group substituted into Y or R; wherein M is a counterion to the solubilizing groups; and wherein s is the number of solubilizing groups;

wherein, when B is cationic, M is an anion and s is from 1 to about 8; when B is nonionic, B is polyethoxylate, M is zero, s is from 1 to about 8, and the number of condensed ethylene oxide molecles per porphine molecule is from about 8 to about 50; when B is anionic and proximate, M is cationic and s is from 3 to about 8; when B is anionic and remote, M is cationic and s is from 2 to about 8; and when B is sulfonate the number of sulfonate groups is no greater than the number of aromatic and heterocyclic substituent groups.

2. The process of claim 1 wherein the porphine bleach is from 0.003 to 0.022 wt.% based on the weight of the composition.

3. The process of claim 1 where the porphine bleach is a compound other than zinc phthalocyanine sulfonate.

4. The process of claim 1 wherein the peroxy bleach is an alkali metal salt of perborate, percarbonate, persulfate, persilicate, perphosphate or perpolyphosphate; urea peroxide; or diperazeleic acid, diperdodecanedioic acid, monoperoxyphthalic acid, diperoxyterephthalic acid, 4-chlorodiperoxyphthalic, the monosodium salt of diperoxyterephthalic acid, m-chloroperoxybenzoic acid, p-nitroperoxybenzoic acid, or diperoxyisophthalic acid.

5. The process of claim 1 wherein A is 2(H) or Zn(II); and B is pyridinium, quaternary ammonium, polyethoxylate, sulfonate, carboxylate, polyethoxycarboxylate, sulfate, polyethoxysulfate, phosphate, or polyethoxyphosphate.

6. The process of claim 1 wherein A is 2 (H) atoms bonded to diagonally opposite nitrogen atoms, or Zn(II), Cd(II), Mg(II), Sc(III), or Sn(IV).

7. The process of claim 1 wherein the composition additionally contains an exotherm control agent selected from the group consisting of boric acid, malic acid, maleic acid, succinic acid, phthalic acid, glutaric acid, adipic acid, azelaic acid and dodecanedioic acid which is present in the amount of at least 50% of the amount of organic peroxy bleach present.

8. The process of claim 1 wherein the available oxygen content of the peroxy bleach is from 0.2 to 0.7 wt.% based on the weight of the composition.

9. The process of claim 8 wherein A is 2(H) atoms bonded to diagonally opposite nitrogen atoms, or Zn(II), Cd(II), Mg(II), Sc(III), or Sn(IV).

10. The process of claim 1 wherein the available oxygen content of the peroxy bleach is from 0.2 to 0.5 wt.% based on the weight of the composition.

11. The process of claim 10 wherein the porphine bleach is from 0.003 to 0.022 wt.% based on the weight of the composition.

12. The process of claim 10 where the porphine bleach is a compound other than zinc phthalocyanine sulfonate.

13. The process of claim 1 wherein the surfactant is from 10% to 30% by weight of the composition and, where the surfactant is anionic, is soap or a water-soluble salt of alkyl benzene sulfonate having about 9 to about 15 carbon atoms in a linear or branched alkyl chain, alkyl sulfate, alkyl polyethoxy ether sulfate, paraffin sulfonate, alpha-olefin sulfonate, alpha-sulfocarboxylates and their esters, alkyl glyceryl ether sulfonate, fatty acid monoglyceride sulfates and sulfonates, alkyl phenol polyethoxy ether sulfate, 2-acyloxyalkane-1-sulfonate, and beta-alkyloxy alkane sulfonate; where the surfactant is nonionic, is a polyethoxylate of an alcohol, alkyl phenol, polypropoxy glycol, or polypropoxy ethylene diamine; where the surfactant is semipolar, is amine oxide, phosphine oxide or sulfoxide; where the surfactant is ampholytic, is a water-soluble derivative of an aliphatic secondary or tertiary amine in which the aliphatic moiety is straight chain or branched and wherein one of the aliphatic substituents contains from about 8 to 18 carbon atoms and one contains an anionic water-solubilizing group; where the surfactant is zwitterionic, is a water-soluble derivative of an aliphatic quaternary ammonium, phosphonium or sulfonium cationic compound in which the aliphatic moieties are straight chain or branched, and wherein one of the aliphatic substituents contains from about 8 to 18 carbon atoms and one contains an anionic water solubilizing group; and where the surfactant is cationic, has the formula $$R_m^1R_x^2Y_LZ$$

wherein each $R^1$ is an organic group containing a straight or branched alkyl or alkenyl group optionally substituted with up to 3 phenyl groups and optionally interrupted by up to 4 structures selected from the group consisting of

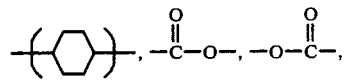

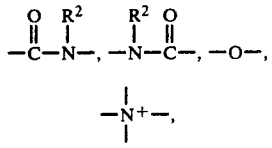

(1)

(2)

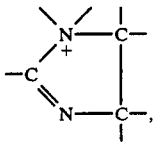

(3)

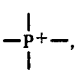

(4)

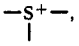

(5)

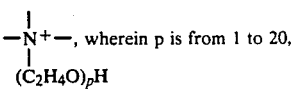

, wherein p is from 1 to 20,

-continued (6)

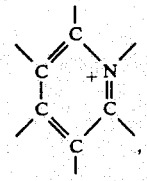

(7)

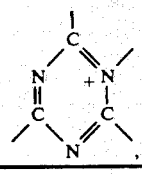

, and (8) mixtures thereof,

L is a number from 1 to 10, Z is an anion in a number to give electrical neutrality.

14. The process of claim 13 wherein the peroxy bleach is an alkali metal salt of perborate, percarbonate, persulfate, persilicate, perphosphate or perpolyphosphate; urea peroxide; or diperazeleic acid, diperdodecanedioic acid, monoperoxyphthalic acid, diperoxyterephthalic acid, 4-chlorodiperoxyphthalic, the monosodium salt of diperoxyterephthalic acid, m-chloroperoxybenzoic acid, p-nitroperoxybenzoic acid, or diperoxyisophthalic acid; A is 2(H) or Zn(II); and B is pyridinium, quaternary ammonium, polyethoxylate, sulfonate, carboxylate, polyethoxycarboxylate, sulfate, polyethoxysulfate, phosphate, or polyethoxyphosphate.

15. The process of claim 14 wherein the available oxygen content of the peroxy bleach is from 0.2 to 0.7 wt.% based on the weight of the composition.

16. The process of claim 15 wherein the surfactant is alkyl benzene sulfonate.

17. The process of claim 15 wherein the peroxy bleach is sodium perborate monohydrate or tetrahydrate.

18. The process of claim 15 wherein the porphine bleach is zinc phthalocyanine sulfonate.

19. The process of claim 15 wherein the porphine bleach is from 0.003 to 0.022 wt.% based on the weight of the composition.

20. The process of claim 15 wherein the porphine bleach is a compound other than zinc phthalocyanine sulfonate.

21. The process of claim 14 wherein the porphine bleach is from 0.003 to 0.022 wt.% based on the weight of the composition.

22. The process of claim 14 where the porphine bleach is a compound other than zinc phthalocyanine sulfonate.

23. The process of claim 14 wherein the available oxygen content of the peroxy bleach is from 0.2 to 0.5 wt.% based on the weight of the composition.

24. The process of claim 23 wherein the surfactant is alkyl benzene sulfonate, the peroxy bleach is sodium perborate tetrahydrate, and the porphine bleach is zinc phthalocyanine tetrasulfonate.

25. The process of claim 23 wherein the porphine bleach is from 0.005 to 0.017 wt.% based on the weight of the composition.

26. The process of claim 23 wherein the porphine bleach is a compound other than zinc phthalocyanine sulfonate.

27. The process of claim 23 wherein the porphine bleach is from 0.003 to 0.022 wt.% based on the weight of the composition.

28. The process of claim 27 wherein the composition additionally contains a peroxy bleach activator comprising an acylating agent selected from the group consisting of N,N,N',N'-tetraacetyl ethylene diamine, N-acetyl imidazole, N-benzoyl imidazole, N,N'-dimethyl barbitone, N,N'-diacetyl-5,5'-dimethylhydantoin, N,N,N',N'-tetraacetyl glycoluril, sodium p-acetoxybenzene sulphonate, sodium p-benzyloxy benzene sulphonate, acetyl salicyclic acid, chloracetoxy salicyclic acid, trimethylcyanurate and mixtures thereof; wherein the amount of peroxy bleach activator is at a ratio to inorganic peroxy bleach of 1:1 to about 1:20.

29. The process of claim 27 wherein the composition additionally contains from 10 to 60% of a detergency builder selected from the group consisting of water-soluble alkali metal carbonates, borates, phosphates, polyphosphates, bicarbonates, and silicates; sodium and potassium ethylenediamine-tetraacetates, nitrilotriacetates and N-(2-hydroxyethyl)-nitrilodiacetates; sodium and potassium phytates; sodium, potassium and lithium salts of ethane-1-hydroxy-1, 1-diphosphonic acid, methylene diphosphonic acid, ethylene diphosphonic acid, ethane-1,1,2-triphosphonic acid; the alkali metal salts of ethane-2-carboxy-1,1-diphosphonic acid, hydroxymethanediphosphonic acid, carbonyldiphosphonic acid, ethane-1-hydroxy-1,1,2-triphosphonic acid, ethane-2-hydroxy-1,1,2-triphosphonic acid, propane-1,1,3,3-tetraphosphonic acid, propane-1,1,2,3-tetraphosphonic acid, and propane-1,2,2,3-tetraphosphonic acid; and amorphous and crystalline aluminosilicates.

* * * * *